United States Patent [19]

Roberts et al.

[11] 3,959,983

[45] June 1, 1976

[54] VARIABLE CAPACITY WOBBLE PLATE COMPRESSOR

[75] Inventors: Richard W. Roberts, Lombard; Ralph D. Salle, Lake Zurich, both of Ill.

[73] Assignee: Borg-Warner Corporation, Chicago, Ill.

[22] Filed: Nov. 5, 1974

[21] Appl. No.: 521,012

Related U.S. Application Data

[62] Division of Ser. No. 347,759, April 4, 1973, Pat. No. 3,861,829.

[52] U.S. Cl. ..... 62/226

[51] Int. Cl.[2] ..... F25B 31/00

[58] Field of Search ..... 417/222, 270, 269, 53; 62/226

[56] References Cited

UNITED STATES PATENTS

| | | | |
|---|---|---|---|
| 2,400,119 | 5/1946 | Joy | 417/222 |
| 2,964,234 | 12/1960 | Loomis | 74/60 |
| 3,062,020 | 11/1962 | Hadorn | 62/226 X |
| 3,712,759 | 1/1973 | Olson | 417/269 |

*Primary Examiner*—William E. Wayner
*Attorney, Agent, or Firm*—Thomas B. Hunter

[57] ABSTRACT

A controlled, variable displacement, wobble plate compressor includes a pivotable wobble plate driven through an improved drive and support linkage including a universal joint and having its pivot point offset from the axis of the drive shaft so that at the "no stroke" position the pistons are all disposed at their top-dead-center positions. The capacity of the compressor is controlled by an improved system for varying the position of the wobble plate.

6 Claims, 6 Drawing Figures

FROM OIL PUMP

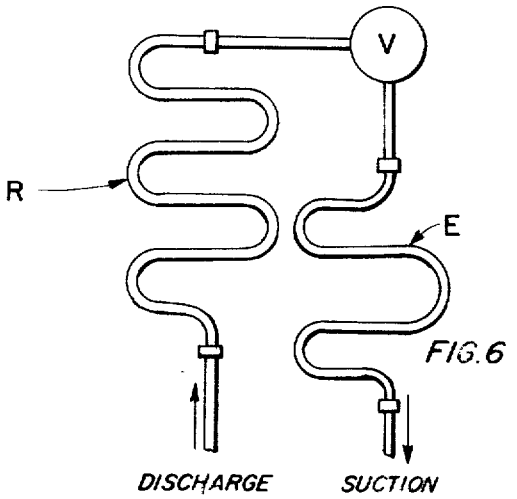
FIG. 6
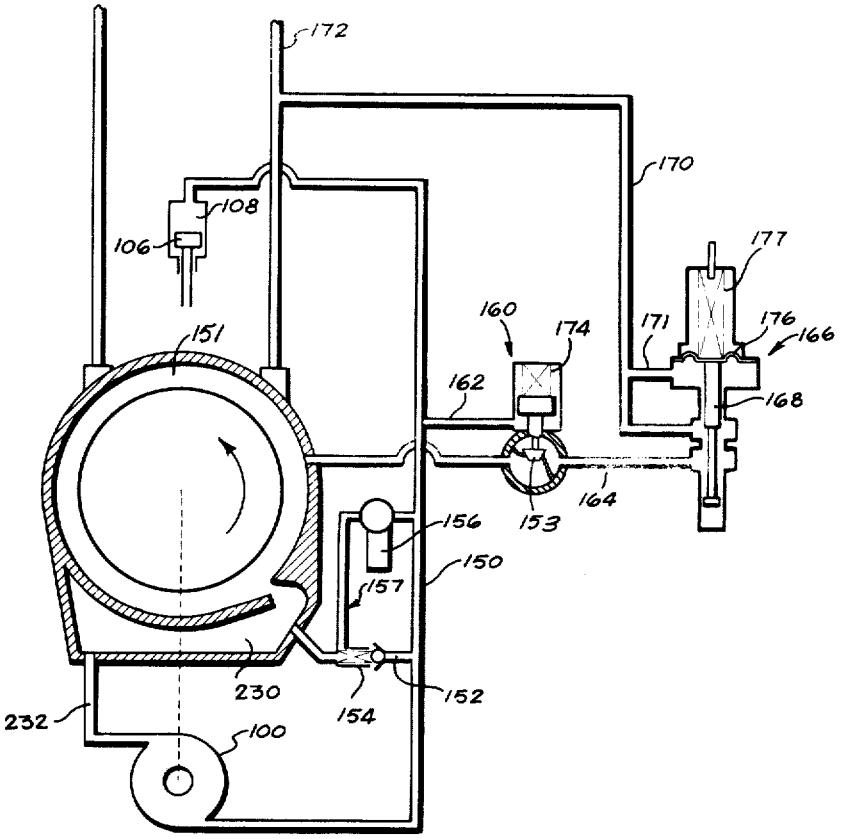

VARIABLE CAPACITY WOBBLE PLATE COMPRESSOR

CROSS REFERENCE TO RELATED APPLICATION

This application is a division of U.S. application Ser. No. 347,759 filed Apr. 4, 1973 entitled "Variable Capacity Wobble Plate Compressor", now U.S. Pat. No. 3,861,829 issued Jan. 21, 1975 to Richard W. Roberts and Ralph D. Salle.

BACKGROUND AND SUMMARY OF THE INVENTION

This invention relates generally to rotary wobble plate compressors and more particularly to an improved wobble plate construction wherein the wobble plate is pivoted from a point radially spaced or offset from the axis of the drive shaft so that the no-stroke position, i.e. that position which results in negligible piston movement, corresponds to the top-dead-center position of the pistons.

The advantages of wobble plate type compressors are well recognized in the art. Such compressors (or fluid motors) utilize a plate, the position of which is movable out of a plane normal to the direction of piston travel to permit varying of the stroke and thereby the displacement or capacity of such units. Essentially, such compressors may be considered rotary devices in that a substantial portion of the mass is undergoing a rotary motion, thereby contributing to the smoothness and quietness of operation. On the other hand, the pistons reciprocate and thereby have the advantage of reciprocating piston devices with their convenient adaption for capacity control and efficient sealing. One main difference between the wobble plate type compressor and the conventional reciprocating compressor is that the pistons travel in the same direction as the axis of the rotating drive element, as distinguished from the radially reciprocating motion of pistons in a conventional reciprocating piston device. As is well known in the art, with three or more uniformly spaced, axially reciprocating piston masses, the resulting unbalance is a rotating couple. This couple can be balanced by suitably disposed masses on the rotating shaft, and is usually accomplished in devices of this type by properly sizing the inclined rotating element. These features are responsible for a much smoother, more vibrationless and quieter apparatus, while combining the efficiency of the reciprocating pistons as a gas compressing element.

Heretofore, most wobble plates have been constructed so that they pivot around a point lying along the axis of the drive shaft. While this is satisfactory for hydraulic pumps or motors, it creates a problem with respect to compressing a fluid such as conventional halocarbon refrigerants. In the fully unloaded or no-stroke position, the pistons are disposed approximately half way between their top-dead-center and bottom-dead-center positions. With this type of mechanism, when reducing the stroke from the full stroke condition, the relative clearance volume increases very rapidly with a decrease in stroke. At high pressure ratios, this drastically reduces the pumping capability of the compressor and it will cease to deliver any flow at all long before the zero stroke position is reached.

In the present invention, the wobble plate is adapted to be pivoted from a point which will result in minimal clearance volume at zero capacity and throughout the entire capacity range. Additional features of the invention include means for anchoring the wobble plate against rotation with a universal joint, a means of partially balancing the forces on the pistons and wobble plate to reduce the stress and wear on the moving parts, and an improved capacity control which greatly reduces the losses of this compressor at partial load compared to all other known means of capacity control.

DESCRIPTION OF THE DRAWINGS

FIG. 6 is a schematic diagram of the capacity control system.

DETAILED DESCRIPTION OF THE INVENTION

Figure 1:
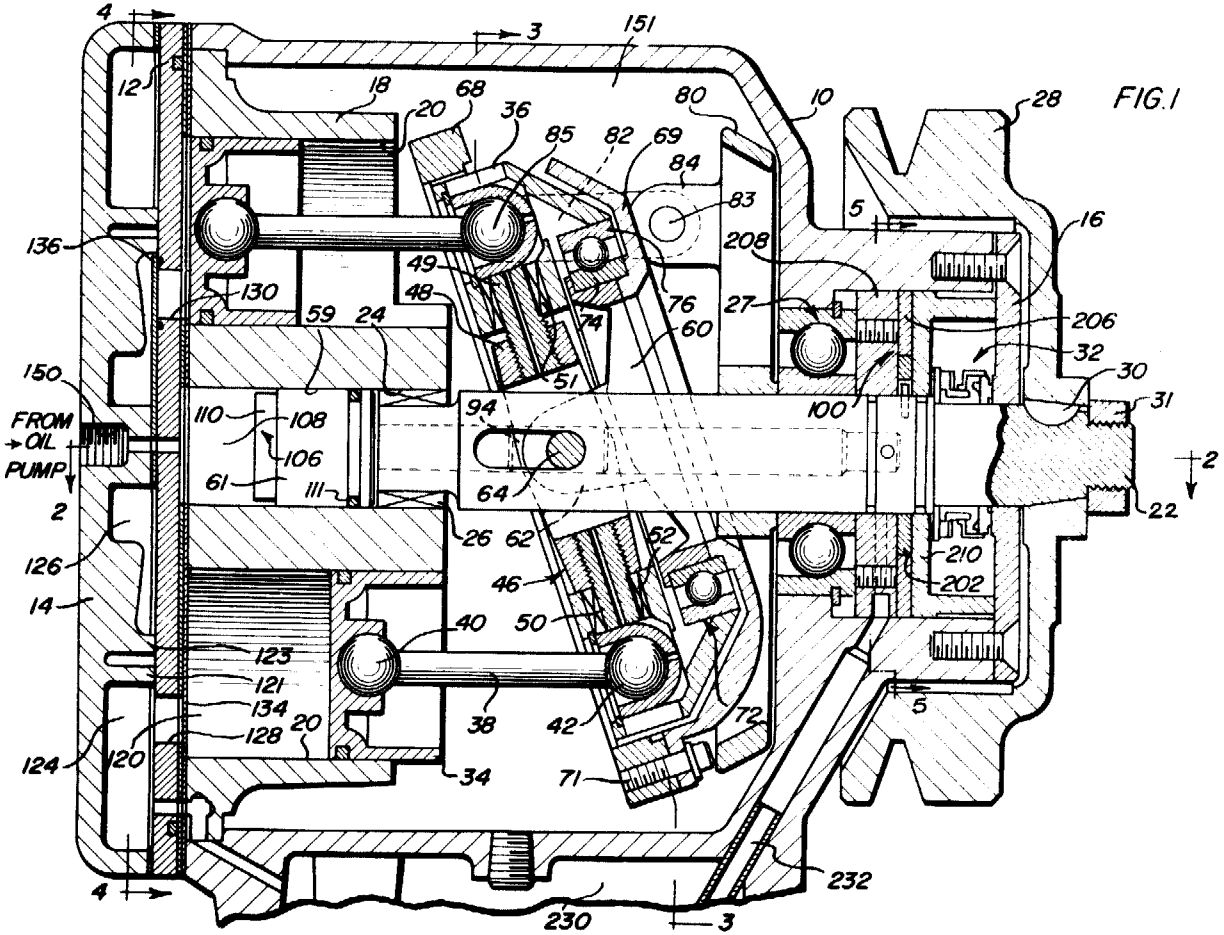
FIG. 1 is a cross-sectional view of a compressor constructed in accordance with the principles of the present invention with the wobble plate shown in full capacity position.
Figure 2:
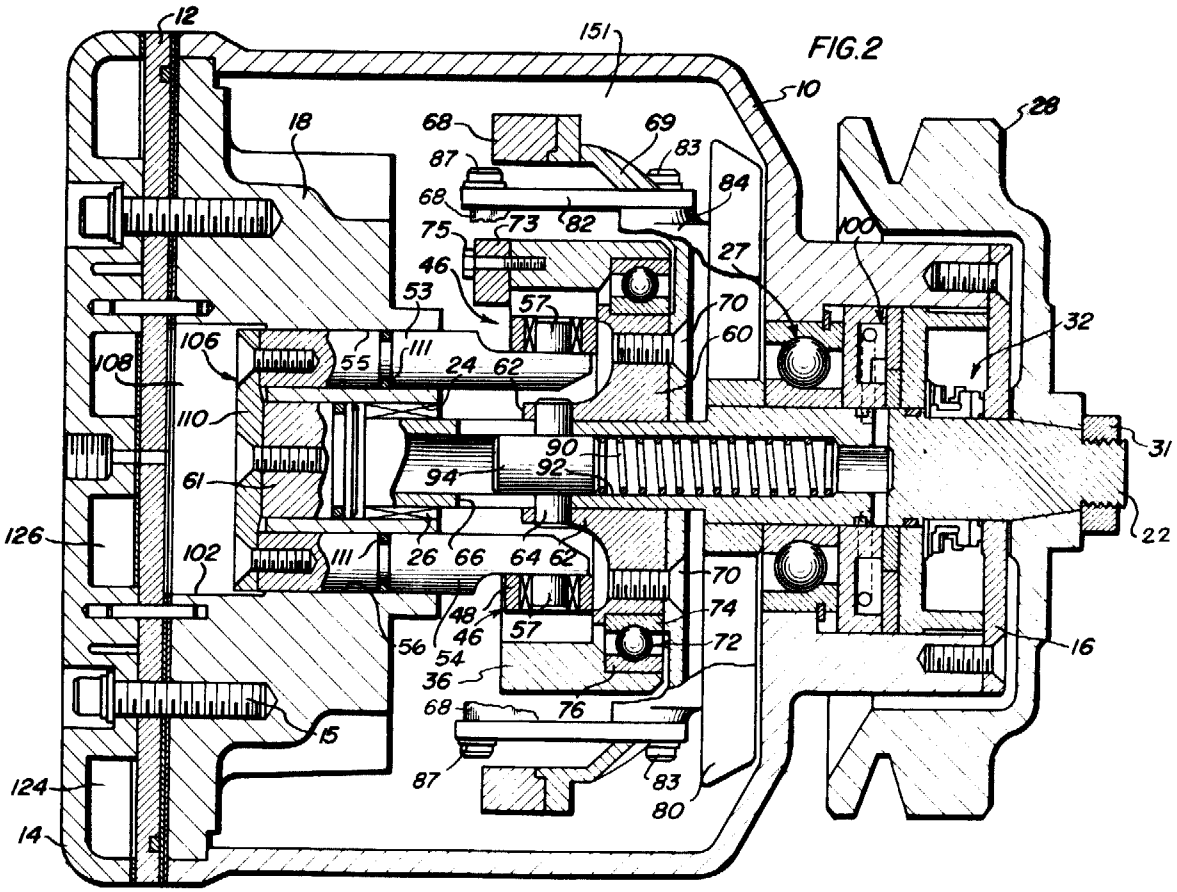
FIG. 2 is a cross-sectional view taken generally along the plane of line 2—2 of FIG. 1, but with the wobble plate moved to its zero capacity position so that it rotates in a plane normal to the axis of the drive shaft.

Referring now to the drawings, and particularly to FIGS. 1 and 2, the compressor of this invention comprises a housing 10 having a first open end (left side of FIG. 1) closed by a porting plate 12 and its opposite end enclosed by a cover plate 16. Received within housing 10, at the left-hand end thereof (FIG. 1), is a cylinder block 18 having a plurality of circumferentially spaced cylinders 20 formed therein. Drive shaft 22 has one end supported within a bore 24 in the cylinder block 18 by needle bearings 26 and is held near its opposite end by bearing assembly 27. This shaft is of rectangular cross-section for that portion of its length which extends between bearing 26 and the reaction ring 80. Shaft 22 is driven by a pulley 28 which is secured to the right-hand end (FIG. 2) of the drive shaft by a key 30 and threaded collar 31. The pulley, at least in an automotive air conditioning application, would normally be driven from the engine through a V-belt. A seal assembly 32 surrounds the drive shaft and cooperates with the inside surface of cover plate 16 to provide a fluid tight, rotatable connection.

The pistons 34, which reciprocate in cylinders 20, are driven by a wobble plate 36 through connecting rods 38 each having a first ball and socket fitting 40 connecting them to the pistons and a second ball and socket fitting 42 connecting them to the wobble plate 36.

The wobble plate 36 is anchored against rotation by means of a universal joint assembly, designated generally at 46. The universal joint comprises a yoke 48 having oppositely disposed trunnions 49, 50 received in bearings 51, 52 in the wobble plate 36. The yoke 48 is supported for journalled movement along the other axis by a pair of control pistons 53, 54 received in complementary bores 55 and 56 in the cylinder block. Each control piston has a pivot 57 receivable in bearings 58 in the yoke to permit the latter to rock back and forth along a horizontal axis.

Figure 3:
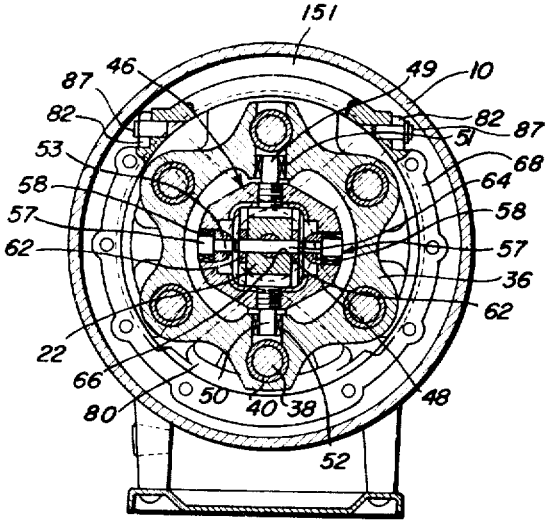
FIG. 3 is a cross-sectional view taken along the plane of line 3—3 of FIG. 1.

The drive shaft 22 supports a drive ring 60 having a cylindrical outside surface and a pair of ears 62 extending forwardly and connected to each other by means of a pin 64 which extends through an elongated slot 66 in the drive shaft. The two inner surfaces of the drive ring and its ears are in sliding engagement with the rectangular portion of drive shaft 22 as shown in FIGS. 2 and 3. The wobble plate 36 is supported on the drive ring by means of a ball bearing assembly 72 having its inner race 74 fitted onto the O.D. of the drive ring and its outer race 76 fitted into a recess on the inside surface of the wobble plate 36. This, of course, permits the drive ring 60 to rotate about the drive shaft axis but allows the wobble plate to maintain a non-rotatable position with respect to said axis. When the drive ring and balance ring are inclined with respect to the axis, the wobble plate will undergo a nutating motion causing axial reciprocating movement of the pistons 34 driven by the connecting rods 38.

When the wobble plate is normal to the shaft 22 it is obvious that conventional balancing techniques can result in excellent rotational balance and vibration free operation. When the wobble plate is inclined, however, a much more complex situation exists. To obtain ideal balance, it is necessary that the following three conditions be fulfilled: (1) the magnitude and distribution of the masses in the rotating elements of the wobble plate assembly must balance the rotating couple generated by the reciprocating pistons. Fortunately, when this is achieved at one angle of inclination and speed, it then holds for all combinations of speed and stroke; (2) the center of gravity of the rotating elements of the wobble plate assembly must fall on the center of the pin 64; and (3) the center of gravity of the nutating elements of the wobble plate assembly must fall on the center of pin 64.

To achieve conditions (1) and (2), the balance ring support 69, which is attached to the back side of drive ring 60 by screws 70, is made of aluminum or magnesium to keep the weight as low as possible. The balance ring 68 is made of a heavy material such as iron or steel and fastened to support 69 with screws 71. To achieve condition (3), six counterweights 73 (only one of which is shown — FIG. 2) are attached by screws 75 to the wobble plate 36 at points intermediate the connecting rods.

The balance ring 68 is also connected to a reaction ring 80 by means of a pair of links 82 attached, by means of pins 83, to ears or bosses 84 extending forwardly on the reaction ring such that the pivot point of the balance ring is spaced from the drive shaft axis at a point 85 near the upper left-hand portion of the apparatus in the position viewed in FIG. 1. The links 82 are pivotably attached to the balance ring 68 by means of pins 87 (see FIG. 3). The pivot point 85 is not rigidly located with respect to the shaft, but is on the end of the two links 82 which are free to pivot on pins 83 and 87, the former being connected to the bosses 84 on reaction ring 80. The use of links instead of a rigid location of pivot point 85 permits the pin 64 to remain at all times on the centerline of the shaft 22 (i.e. a straight slot) which is important for balance considerations.

The major axial loads on the wobble plate 36 are transmitted through the bearing 72, the balance ring support 69, and the balance ring 68 to the links 82. The links then transmit the axial forces to the reaction ring 80, then through the bearing assembly 27 to the housing 10. The reaction ring 80 is pressfitted onto, and driven with, the drive shaft 22.

The shaft 22 rotates and carries with it the reaction ring 80 and the drive ring 60. All of the driving torque is transmitted to the drive ring through the closely fitting flats on the shaft 22, and drive ring 60. Both the drive ring 60 and the balance ring support 69 are rigidly clamped to the inner race 74 of the large ball bearing. The balance ring support 69 is connected to the balance ring 68 by bolts 71, and the balance ring 68 is further connected to the reaction ring 80 through the links 82 as outlined previously. The links 82 do not carry any torque loads.

The wobble plate 36 is supported on the outer race 76 of the large ball bearing and is anchored against rotation by the universal joint assembly 46 and the control rods 53. Now, when the ball bearing is in an inclined position as shown in FIG. 1, and the inner race 74 is forced to rotate by the shaft 22 and the drive ring 60, the inner race acts as a cam to impart to the outer race 76 and the wobble plate 36 a nutating motion.

An important feature of the invention resides in the design to balance the forces acting on the wobble plate. In the structure as heretofore described, there would always be a tendency for the wobble plate to be urged to its fully inclined, full stroke position. This is because the reaction forces opposing piston movement in the cylinders at the lower half of the compressor (as viewed in FIG. 1) would be inclined to tilt the wobble plate around the upper pivot point. To compensate for these forces it is desirable to pressurize the crankcase with gas in such a way that the pressure is applied to the underside of each piston. In this regard, it has been found that the pressure maintained inside the housing 10 should be between 5–10% of the difference between suction and discharge pressure at all times. For example, when operating a 200 psig discharge and 30 psig suction, the crankcase pressure should be controlled between 38.5 and 47 psig. In practice, the gas blowing by the piston sealing rings is enough to pressurize the chamber.

A compression spring 90 is provided in a blind bore 92 extending axially through the drive shaft 22. One end of the spring abuts the blind end of the bore and the opposite end engages a cylindrical guide 94 through which pin 64 extends. The spring force thus urges the pin 64 and the drive ring 60 to which it is connected, to the left (as viewed in FIG. 1) to bias the wobble plate in the upright position. When in the zero stroke position, no gas blow-by will be available so the spring 90 will hold the wobble plate in this position until the control calls for increased stroke. The wobble plate is controlled hydraulically by high pressure oil from the discharge side of oil pump 100, the details of which will be given below. As viewed in FIG. 2, it will be noted that there is a hollowed out section 102 of cylinder block 18 which terminates at one end (the left as viewed in FIG. 2) at the porting plate 12 and at the other end in three cylindrical bores 55, 56, previously described, and 59, which is an extension of the bore containing bearing 26. A piston assembly 106 is arranged in the chamber 108 defined by hollowed out section 102 which assembly includes a control rod bridge 110, the control pistons 53, 54 respectively slidable in the bores 55, 56, and the centrally located piston 61 in bore 59. O-ring seals 111 surround each of the pistons 53, 54 and 61 to isolate the pressure applied to chamber 108 from the pressure in the crankcase.

As mentioned above, each of pistons 53, 54 has a pivot 57 journalled into yoke 48 of the universal joint assembly. Accordingly, the angle at which the wobble plate is disposed is controlled by the position of piston assembly 106 and the two control pistons 53, 54 which urge the universal joint yoke 48 forwardly or rearwardly and thereby control the position of the wobble plate, the drive ring and the balance ring, all of which move together as a unit about the pivot point.

Figure 4:
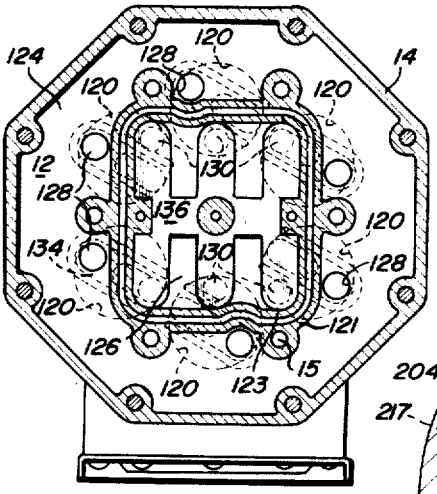
FIG. 4 is a cross-sectional view taken along the plane of line 4—4 of FIG. 1.
Figure 5:
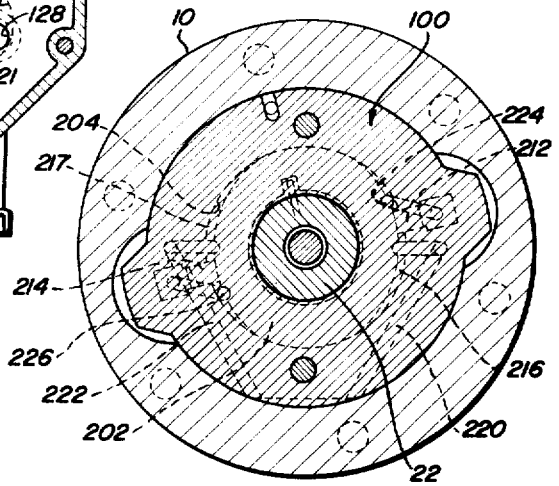
FIG. 5 is a cross-sectional view taken along the plane of line 5—5 of FIG. 1.

Refrigerant gas is admitted to and discharged from the gas working spaces 120 (defined by cylinders 20, porting plate 12 and pistons 34) through head 14, which is secured to the porting plate 12 and cylinder block 18 by capscrews 15. As best shown in FIG. 4, the head is provided with a pair of closely spaced partition walls 121, 123 that cooperate with porting plate 12 to divide the head into an outer suction gas plenum 124 and an interior discharge gas chamber 126. Suction plenum 124 and discharge chamber 126 are provided with suction and discharge gas connections or fittings (not shown) to which the gas lines are connected to the compressor.

Porting plate 12 is provided with first series of suction gas ports 128 through which gas flows from suction plenum 124 to the working spaces 120 and a second series of discharge ports 130 through which the compressed gas flows from working spaces 120 to discharge gas chamber 126. The suction ports are closed by suction valves 134 and the discahrge ports are closed on the opposite side of porting plate 12 by discharge valves 136.

The oil pump 100 is disposed at the right-hand end (FIG. 1) of the apparatus. The pump comprises a generally elliptically shaped rotor 202, which is secured to and driven by the drive shaft 22, said rotor being disposed in a cylindrical pumping chamber 204 formed by stator 206 and two spaced end plates 208 and 210. Engaging the surface of the rotor are two opposed vanes 212, 214 which project out of the stator and are spring loaded in a radially inward direction to maintain sliding engagement with the rotor surface. The rotor 202 and pumping chamber 204 therefor define a pair of pumping cavities 216, 217 which are connected on the one hand with the suction side of the oil pumping system through passages 220 and 222, and to the discharge side of the pumping system through passages 224 and 226 which are connected through passages (not shown) to line 150. The oil is picked up in the lower portion of the housing which forms an oil sump 230 and flows through angular passage 232 to the suction ports communicating with the pumping cavities. The pressurized oil is used to regulate the stroke of the compressor by means of piston assembly 106 together with a suitable control system described below. Excess oil can be discharged axially through the center of the drive shaft to various oil passages communicating with critcal elements such as, for example, bearings 26 and 27.

A suitable capacity control system is illustrated schematically in FIG. 6. The crankcase oil sump 230, it will be recalled, is connected by means of lines 232 to the inlet side of oil pump 100. The flow of oil is directed through line 150 to chamber 108 controlling the stroke control piston assembly 106. In parallel with the oil pump is a branch line 152 which includes a relief valve 154 normally set to open at a pressure about 30–60 psi above crankcase pressure. In parallel with the relief valve 154 is a normally open solenoid valve 156 which connects line 150 with line 152 downstream from relief valve 154.

A zero-stroke valve 160, the operation of which will be described in more detail below, is connected via line 162 so as to be actuated by oil pressure in line 150. Valve 160 controls the flow of gas from the crankcase through line 164 in response to oil pressure under certain conditions. The main control valve 166 comprises a valve element 168 controlling flow between lines 164 and line 170, the latter being connected with the suction gas line 172. The zero-stroke valve 160 is operated by oil pressure in opposition to a spring 174 which in the absence of oil pressure prevents gas flow from the crankcase to the main control valve through line 164. Control valve 166 is controlled in response to the pressure sensed in suction line 172 (which is the variable that is ultimately controlled) by means of a diaphragm 176 sensing suction pressure through lines 170 and 171 in cooperation with a spring 177 biasing the diaphragm in the opposite direction. The position of element 168 controls flow of gas from the crankcase through lines 164, the control valve body and line 170.

OPERATION

The operation will be described in the context of varying the capacity from full stroke (with the wobble plate shown in the position of FIG. 1) to the no stroke position (with the wobble plate as shown in FIG. 2). The drive from the V-belt (not shown) is applied to pulley 28 which through the connection with drive shaft 22 causes the same to rotate. The torque is thus transmitted to drive ring 60 by the engagement of the flats on the drive shaft with the corresponding surfaces on the drive ring 60. As the drive ring rotates, it causes the wobble plate to follow a nutating path driving the pistons 34 through connecting rods 38. The gas admitted to the working spaces 120 through suction valves 134 (see FIG. 4) on the opposite side of porting plate 12. On the discharge stroke of each cylinder, the gas is forced through a discharge valve 136 into discharge chamber 126.

As long as the full capacity of the compressor is required (i.e. the suction pressure in line 172 is above the control pressure of approximately 30 PSIG) the gas pressure loads on the pistons 34 hold the wobble plate assembly at its maximum angle of inclination. During the compression stroke there is leakage of high pressure gas past the pistons (referred to later as blow-by) into the crankcase cavity 151 which is vented to suction.

The control shown schematically in FIG. 6, is based on the regulation of the escape of blow-by gas from the crankcase to suction which raises or lowers the crankcase pressure in response to a signal from the suction pressure resulting in a decrease or increase in the compressor displacement as follows:

When the air conditioning system is operating, the normally open solenoid valve 156 is energized and held in the closed position. The pump 100 draws oil from the sump 230 and elevates it to the pressure set by the relief valve 154. This pressure is communicated through lines 150 to chamber 108 and piston assembly 106 to urge the compressor into stroke, and through 150 and 162 to the annular piston area of element 153 in the zero-stroke valve 160. Element 153 is held upward against a spring 174 and opens the line 164 venting the crankcase through lines 164, control valve 166, and line 170 to suction line 172. When the suction pressure in line 172 gets down to the control pressure (sensed on the backside of diaphragm 176 through lines 170 and 171) the spring 177 moves the diaphragm 176 and valve 168 downward thereby restricting the communication between the crankcase 151 and the suction line 172. Since the leakage of gas past the pistons into the crankcase continues, this restriction in the body of valve 166 causes an increase in pressure in the crankcase 151 of the compressor. This pressure acting on the underside of the piston 34 results in a decrease in angularity of the wobble plate mechanism and consequently a reduction in the piston stroke and the displacement of the compressor. Similarly, it can be seen that when the compressor is at less then the minimum stroke, an increase in pressure in line 172 will cause the valve element 168 to move upward reducing the restriction between the crankcase 151 and suction line 172. This increases the flow rate of blow-by gases out of the crankcase and reduces the crankcase pressure allowing the compressor displacement to increase and lower the suction pressure in line 172. Experimental measurements taken from a compressor built and operating in the described manner show that the crankcase pressure normally falls between 5% and 10% of the difference between suction and discharge pressure.

When the system is turned off, the normally open solenoid valve 156 is de-energized so that it opens and permits a free circulation of oil back to the sump 230. This reduces the oil pressure behind the piston assembly 106 and beneath the annular piston of the movable element 153 in the zero-stroke valve 160. Spring 174 forces the movable element 153 downward to close the passage 164. The trapped blow-by gas rapidly mixes the crankcase pressure sufficiently to return the wobble plate to the zero-stroke condition.

While the compressor described herein has obvious utility in any application where gas or vapor compression means are required, as distinguished from a hydraulic pump, one very important application would be in an air conditioning or refrigeration system. Accordingly, in FIG. 6 there is shown a conventional vapor cycle compression system including the compressor C, the condenser R, an expansion device V and an evaporator E. The refrigerant is compressed in the compressor and flows to the condenser R which is cooled by water or air and thus liquifies the refrigerant. The high pressure liquid refrigerant then flows through the expansion device, which may be fixed as in a capillary system or a variable expansion valve. Low pressure liquid refrigerant then flows to the evaporator where it is brought into contact with a heat exchange fluid to be cooled and refrigerant, undergoing evaporation, abstracts heat from such fluid.

While the invention has been described in connection with a certain specific embodiment thereof, this is by way of illustration and not by way of limitation, and the scope of the appended claims should be construed as broadly as the prior art will permit.

What is claimed is:

1. In an air conditioning apparatus of the type including a condenser, an evaporator and a compressor connected to provide a closed circuit, compression-condensing-evaporation refrigeration system, said compressor comprising means defining a plurality of refrigerant gas working spaces each having a piston cooperating with suction and discharge ports to compress a fluid therein; a drive shaft; a wobble plate driven by said drive shaft in a nutating path about the drive shaft axis; means operably connected between said wobble plate and the individual pistons to impart reciprocating drive to said pistons, the length of stroke being a function of the angle at which said wobble plate is supported relative to the drive axis; means for pivoting said wobble plate at a point spaced from said drive axis so as to permit said wobble plate to be inclined relative to a plane normal to said drive shaft axis, so that when the wobble plate is disposed in said normal plane, the pistons are located at top-dead-center within said gas working spaces; said pistons being enclosed in a fluid tight housing providing a crankcase which is pressurized by fluid bypassing said pistons from said gas working spaces; and means for controlling the pressure within said crankcase including means for sensing pressure of fluid in said evaporator.

2. Apparatus as defined in claim 1 in which said control includes means for venting refrigerant gas in said crankcase to the outlet of said evaporator; valve means interposed between said crankcase and said evaporator outlet for controlling the rate of flow of refrigerant gas vented therethrough; and valve actuating means responsive to the pressure in said evaporator outlet to control said valve means and the corresponding crankcase pressure.

3. Apparatus as defined in claim 2 including means operatively connected to said wobble plate and adapted to urge the wobble plate against the force of fluid pressure applied to said pistons to move said wobble plate to an inclined position relative to said normal plane.

4. Apparatus as defined in claim 3 wherein said means operatively connected to said wobble plate comprises a hydraulic actuator.

5. Apparatus as defined in claim 4 including an oil pump driven by said drive shaft and means for conducting high pressure oil from said pump to said hydraulic actuator.

6. Apparatus as defined in claim 5 including a high pressure relief valve adapted to limit the maximum pressure of oil circulated from said oil pump to said hydraulic actuator.

* * * * *